US006327724B1

(12) United States Patent
Sharrock et al.

(10) Patent No.: US 6,327,724 B1
(45) Date of Patent: Dec. 11, 2001

(54) INFLATABLE POSITIONING AIDS FOR OPERATING ROOM

(75) Inventors: Nigel E. Sharrock, New York; William F. Urmey, Larchmont, both of NY (US); L. Henri Marguet, Glen Ridge, NJ (US)

(73) Assignee: O.R. Comfort, LLC, Glen Ridge, NJ (US)

( * ) Notice: Subject to any disclaimer, the term of this patent is extended or adjusted under 35 U.S.C. 154(b) by 0 days.

(21) Appl. No.: 09/495,596

(22) Filed: Feb. 1, 2000

Related U.S. Application Data

(60) Provisional application No. 60/118,293, filed on Feb. 2, 1999.

(51) Int. Cl.[7] ..... A47C 27/08; A61G 13/12

(52) U.S. Cl. ..... 5/630; 5/654; 5/655.3

(58) Field of Search ..... 5/630, 631, 652, 5/652.1, 652.2, 654, 655.3, 484, 615, 715, 81.1 T

(56) References Cited

U.S. PATENT DOCUMENTS

| | | | | |
|---|---|---|---|---|
| Re. 31,898 | * | 5/1985 | Suter | 52/518 |
| 211,741 | * | 1/1879 | Johnson | 5/630 X |
| D. 279,531 | * | 7/1985 | Rogers, Jr. | D6/601 |
| 744,713 | | 11/1903 | Blomqvist . | |
| 1,468,072 | * | 9/1923 | Ogle | 5/654 X |
| 2,276,911 | | 3/1942 | Alward . | |
| 2,612,645 | * | 10/1952 | Boland | 5/633 X |
| 2,724,133 | | 11/1955 | Sorrell . | |
| 3,505,695 | | 4/1970 | Bishaf et al. . | |
| 3,526,908 | * | 9/1970 | Davis | 5/81.1 T |
| 3,678,926 | | 7/1972 | Strittmatter . | |
| 3,722,012 | * | 3/1973 | Tobinick et al. | 5/665 |
| 3,790,975 | | 2/1974 | Philipp et al. . | |
| 3,803,647 | | 4/1974 | Reswick . | |
| 3,813,716 | | 6/1974 | Francis . | |
| 3,818,962 | | 6/1974 | Muller-Scherak . | |
| 3,822,425 | | 7/1974 | Scales . | |
| 3,872,525 | | 3/1975 | Lea et al. . | |
| 3,895,403 | * | 7/1975 | Davis | 5/81.1 T |
| 3,897,777 | | 8/1975 | Morrison . | |
| 3,935,604 | * | 2/1976 | Collins | 5/630 |
| 3,939,829 | | 2/1976 | Spann . | |
| 3,949,438 | | 4/1976 | Scales . | |
| 3,959,835 | | 6/1976 | Nos . | |
| 3,984,595 | | 10/1976 | Stephens . | |
| 4,025,974 | | 5/1977 | Lea et al. . | |
| 4,042,988 | | 8/1977 | Holliday . | |
| 4,054,960 | | 10/1977 | Pettit et al. . | |
| 4,139,920 | | 2/1979 | Evans . | |
| 4,265,232 | | 5/1981 | Stonich . | |
| 4,371,999 | | 2/1983 | Reid . | |

(List continued on next page.)

FOREIGN PATENT DOCUMENTS

| | | |
|---|---|---|
| 1 529 538 | 3/1970 | (DE) . |
| 361887 | 11/1931 | (GB) . |
| 1 440 193 | 6/1976 | (GB) . |
| 2 113 990 | 8/1983 | (GB) . |

*Primary Examiner*—Robert G. Santos
(74) *Attorney, Agent, or Firm*—Gerald E. Hespos; Anthony J. Casella

(57) ABSTRACT

An inflatable positioning device is provided. The device includes a pump, a tube extending from the pump, a valve intermediate the length of the tube and non-rectangular inflatable pillow connected to the end of the tube remote from the pump. The non-rectangular inflatable pillow is dimensioned for positioning portions of a patient's body during surgery.

16 Claims, 5 Drawing Sheets

U.S. PATENT DOCUMENTS

| | | | | |
|---|---|---|---|---|
| 4,375,809 | | 3/1983 | Meals . | |
| 4,394,784 | | 7/1983 | Swenson et al. . | |
| 4,405,129 | * | 9/1983 | Stuckey | 5/630 X |
| 4,428,087 | | 1/1984 | Horn . | |
| 4,488,715 | | 12/1984 | Comeau . | |
| 4,525,409 | * | 6/1985 | Elesh | 428/193 |
| 4,534,078 | | 8/1985 | Viesturs et al. . | |
| 4,639,960 | | 2/1987 | Quillen et al. . | |
| 4,657,003 | * | 4/1987 | Wirtz | 128/869 |
| 4,669,455 | | 6/1987 | Bellati . | |
| 4,685,163 | * | 8/1987 | Quillen et al. | 5/615 X |
| 4,932,089 | * | 6/1990 | Laviero | 5/421 |
| 4,953,247 | * | 9/1990 | Hasty | 5/713 |
| 4,962,552 | * | 10/1990 | Hasty | 5/713 |
| 4,982,466 | | 1/1991 | Higgins et al. . | |
| 5,012,539 | | 5/1991 | Grigg . | |
| 5,070,559 | | 12/1991 | Pettifer . | |
| 5,235,713 | * | 8/1993 | Guthrie et al. | 5/710 |
| 5,245,719 | | 9/1993 | Ott . | |
| 5,418,991 | | 5/1995 | Shiflett . | |
| 5,427,834 | * | 6/1995 | Sodetz | 428/83 |
| 5,432,967 | * | 7/1995 | Raftery | 5/652 X |
| 5,442,821 | * | 8/1995 | Weeks | 5/89.1 X |
| 5,452,486 | * | 9/1995 | Czako | 5/715 X |
| 5,459,896 | * | 10/1995 | Raburn et al. | 5/653 |
| 5,528,783 | * | 6/1996 | Kunz et al. | 5/615 X |
| 5,548,948 | * | 8/1996 | Smith et al. | 5/654 X |
| 5,568,660 | * | 10/1996 | Raburn et al. | 5/484 X |
| 5,781,943 | * | 7/1998 | Moenning et al. | 5/81.1 C |
| 5,785,669 | | 7/1998 | Proctor et al. . | |
| 5,855,207 | * | 1/1999 | Moenning et al. | 5/81.1 C |
| 6,065,166 | * | 5/2000 | Sharrock et al. | 5/630 |
| 6,131,214 | * | 10/2000 | Moenning et al. | 5/81.1 C |
| 6,154,900 | * | 12/2000 | Shaw | 5/615 X |
| 6,163,905 | * | 12/2000 | Noldus-Nilsen | 5/655.3 |
| 6,175,978 | * | 1/2001 | Nizzi et al. | 5/655.3 X |
| 6,223,368 | * | 5/2001 | Anslin | 5/630 |

* cited by examiner

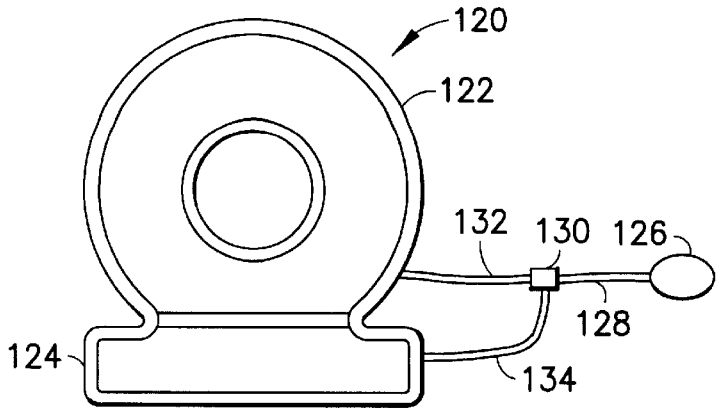
FIG. 10
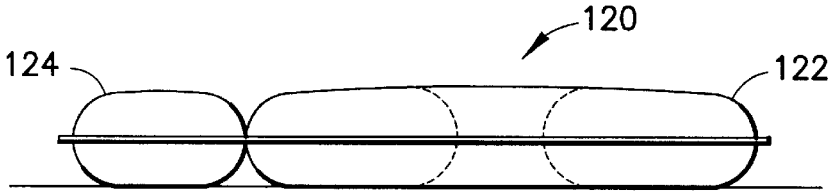
FIG. 11
FIG. 12
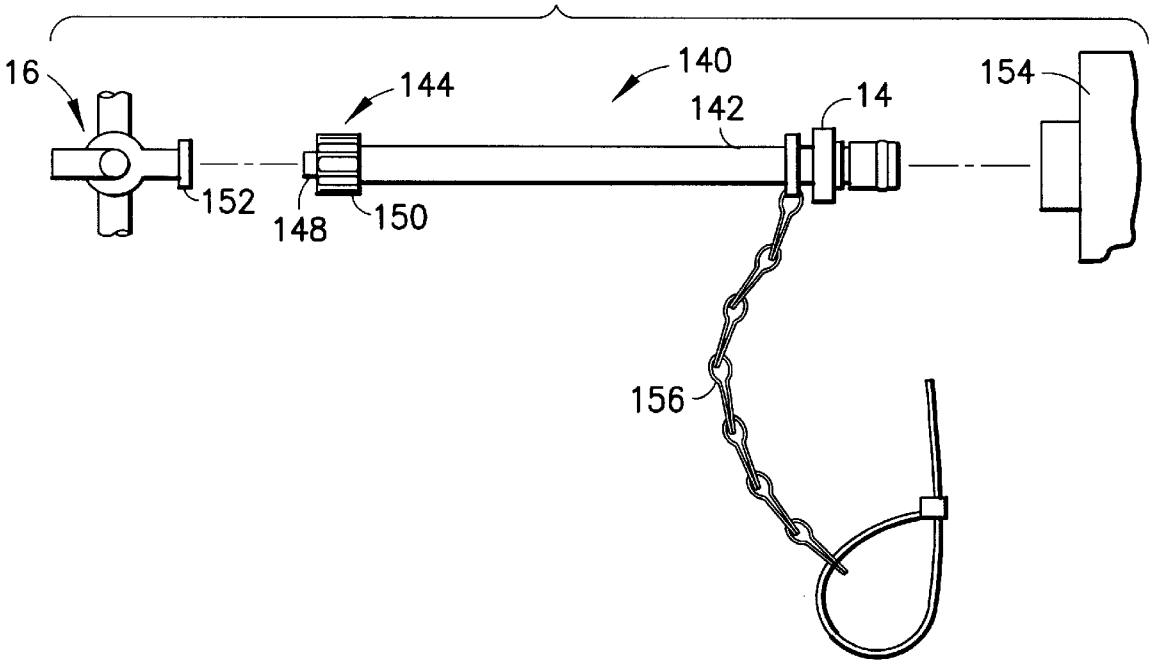

INFLATABLE POSITIONING AIDS FOR OPERATING ROOM

This application claims the benefit of U.S. Provisional Patent Appl. No. 60/118,293 filed Feb. 2, 1999.

BACKGROUND OF THE INVENTION

1. Field of the Invention

The subject invention relates to inflatable positioning aids for an operating room that enable a patient to be conveniently and safely positioned during surgery.

2. Description of the Prior Art

An anesthetized patient must be maintained substantially immovably in a position that enables convenient access by doctors during surgery. Additionally, the anesthetized patient must be positioned in a manner that maintains an open air passage for continuous unstressed breathing. Still further, the anesthetized patient must be positioned in a manner that will prevent long term pressure at a location that could impede blood flow or put pressure on nerves or vital structures.

Doctors and other members of a surgical team continue to use fairly crude positioning devices during surgery. For example, patients may be propped into a selected position by rolled-up sections of blankets, sheets and gauze pads. However, these fairly crude positioning devices do not provide an acceptable degree of control, and do not facilitate repositioning intraoperatively. Furthermore, a roll of fabric, or the like, may create local pressure points that would not be appreciated by the surgical team and that could impede blood flow. A restriction of blood flow during a lengthy operation can cause serious damage to limbs, and hence can require a long term regimen of post-operative physical therapy. Nerve damage or damage to other organs may be permanent.

The prior art has included several inflatable positioning aids. Most of the prior art inflatable positioning aids are very complicated structures that would be costly to manufacture. The complexities arise from having a plurality of angularly aligned internal or external panels that must be carefully secured to one another. The prior art requirement for the plurality of angularly aligned, intersecting and seamed panels adds to manufacturing and assembly costs and substantially complicates quality control inspections of the product.

The assignee of the subject invention also has rights to an inflatable positioning aid. The assignee's inflatable positioning aid is described in copending Application Ser. No. 08/733,629 which was filed on Oct. 17, 1996, and includes: a generally rectangular inflatable pillow; a tube extending into the pillow; a hand pump for directing air through the tube and into the pillow; and a valve for selectively releasing air from the pillow.

Despite the many advantages of the assignee's prior inflatable positioning aid, the need for further improvements has been recognized by the inventors herein. For example, certain types of surgery create unique positioning requirements that may not be met appropriately by a rectangular inflatable pillow.

The subject invention relates to solutions to certain of those unique surgical positioning demands.

SUMMARY OF THE INVENTION

The subject invention is directed to inflatable positioning aids for use during a medical procedure. More particularly, the subject invention relates to inflatable positioning aids that are uniquely configured to meet demands of certain medical procedures. These inflatable positioning aids may be used with a flexible tube, a hand pump for manually inflating the positioning aid and a valve for selectively deflating the positioning aid. The inflatable positioning aid also may be used with the tube, the valve and an adaptor that can be engaged with the flexible tube and with a source of compressed air for automatic inflation of the positioning aid. Such a source of compressed air commonly is present in an operating room. Thus, the use of a source of a compressed air enables very rapid inflation and avoids the need to have a person in the operating room mechanically pump air into the inflatable positioning aid.

In all embodiments, the inflatable positioning aid is formed from a top panel and a bottom panel, at least portions of which are of substantially identical shape. Preferred embodiments of the inflatable positioning aids of the subject invention do not include end panels, side panels or internal panels that would complicate assembly and increase costs. Rather, the desired shape of the inflatable positioning aid is achieved by the careful selection of the non-inflated shapes of the top and bottom panels as described herein. In all embodiments, the inflatable positioning aid is assembled by positioning identically configured portions of the top and bottom panels in registration with one another and seaming the top and bottom panels to one another at selected locations.

At least one of the panels of the positioning aid may include a non-inflatable flap extending beyond the periphery of the inflatable portions of the positioning aid. The flap is disposed at a location on which a portion of the patient will lie. Thus, the flap functions to hold the inflatable positioning aid at a specified location during inflation, and during a medical procedure.

In one embodiment, the inflatable positioning aid defines a wedge-shape after inflation that enables the patient to be shifted from a perfectly horizontal supine position into a position where one side of a patient is elevated slightly. The inflated positioning aid to meet these requirements may be tapered from a first end defining a point or line of substantially zero cross-section to a second end defining a circle, oval or rectangle of larger cross-section. The cross-sectional difference between the first and second ends can be varied by the sizes and shapes of the panels and by the amount of air pumped into the inflatable portion of the positioning aid. Positioning aids of this type will have particularly utility in certain obstetric procedures, such as a caesarian section. In particular, during all childbirth, the uterus tends to compress the vena cava and/or the aorta, thereby impairing blood flow to the fetus (aorto-caval compression syndrome). The shifting enabled by the wedge-shape after inflation displaces the uterus and helps to avoid the compression of the vena cava and/or aorta. The inflatable positioning aid may have a non-inflatable flap extending from one end. The flap may be placed under the patient to prevent lateral shifting as the wedge-shape develops during inflation and to prevent shifting during childbirth.

The subject invention also relates to a non-rectangular inflatable positioning aid intended for supporting the face in surgical procedures that require a patient to be in a prone position. In this position, it is often difficult to conveniently position the face in a manner that will ensure that the air passages remain open. Accordingly, a generally U-shaped inflatable positioning aid may be provided. The U-shaped inflatable portion of the positioning aid may have an inflatable connecting portion and a pair of inflatable arms. The opening between the pair of inflatable arms may be dimensioned to receive the nose and mouth of the patient. In certain embodiments, the opening between the arms may be substantially T-shaped, with the central portion of the T being dimensioned and configured for receiving the nose and mouth, and with the arms of the T being dimensioned and configured for receiving the eyes of the patient, to prevent excessive pressure on the eyes. The inflatable positioning aid of this embodiment may be made of a transparent material to enable the anesthesiologist to clearly see the face and eyes when the patient is in the prone position. Ends of the arms of the inflatable positioning aid remote from the connecting portion may be joined by a sheet member or strap for ensuring that the inflatable arms remain in selected positions relative to one another, and to prevent the inflatable arms from spreading in a manner that would urge the nose and mouth downwardly against the operating table. A non-inflatable flap may further extend from ends of the arms of the inflatable positioning aid remote the connecting portion. The non-inflatable flap will carry the weight of the torso of the patient and will ensure that the inflatable positioning aid does not shift significantly relative to the patient in response to forces generated during inflation or during the medical procedure. A similar configuration may be employed for back surgery. In this embodiment, the inflatable arms diverge in a V-shape. Additionally, the non-inflatable flap may extend from the inflatable connecting portion. The space between the inflatable arms may be positioned to align with the sternum, and the non-inflatable flap may be positioned under the hips.

A third inflatable positioning aid is elongated and dimensioned to extend over substantially the entire torso of a patient. This third inflatable positioning aid includes a generally rectangular top panel and a rectangular bottom panel. The rectangular top and bottom panels may be secured to one another about the periphery of at least one panel. Additionally, an elongated central portion is rendered non-inflatable by securing the central portion of the top panel to the central portion of the bottom panel. Areas of the central portion that are not inflated may extend continuously from one longitudinal end of the rectangular inflatable positioning aid to a location near the opposed longitudinal end. This will create first and second spaced apart longitudinally extending inflatable portions. Additionally, the first and second longitudinally extending inflatable portions are connected to one another at a location in proximity to at least one of the ends. Thus, a single source of air can be employed to inflate both longitudinally extending sections of the inflatable position aid. The non-inflated central portion of this inflatable positioning aid preferably is disposed to substantially align with the spine of the patient. Thus, the spine will extend along the non-inflated groove and will not be subjected to pressure. Furthermore, this positioning aid provides two elongate inflatable supports that ensure uniform stable elevation without rocking or tilting that could occur with a single rectangular chamber under the back. An inflatable positioning aid of this type is particularly useful for heart surgery. To ensure that the inflatable positioning aid does not move, this embodiment may include first and second non-inflatable flaps extending respectively from the opposed longitudinal ends of the inflatable portion. The first non-inflatable flap may be positioned under the hips of the patient, and the second non-inflatable flap may be positioned under the head of the patient. Each flap may be a unitary extension of one panel.

A fourth inflatable positioning aid in accordance with the subject invention is intended for positioning the neck and head when the patient is in a supine position. More particularly, this inflatable positioning aid may include a generally toroidal section dimensioned and configured for supporting the back of the head and an elongate portion for positioning under the neck. The elongate portion may be substantially tangential to the toroidal portion. Additionally, the toroidal portion and the elongate portions may be separately controllable. Thus, the valve employed in this embodiment may differ from the valve employed in other embodiments in that air pressure may be selectively added to or withdrawn from either of the two separate sections of the inflatable support in accordance with the particular needs of the patient.

BRIEF DESCRIPTION OF THE DRAWINGS

FIG. 10 is a top plan view of a fifth inflatable positioning aid in accordance with the subject invention.

FIG. 11 is a side elevational view of the positioning aid shown in FIG. 10.

FIG. 12 is a top plan view of an adaptor to enable use of the inflatable positioning aids with a supply of compressed air.

DETAILED DESCRIPTION OF THE PREFERRED EMBODIMENTS

Figure 1:
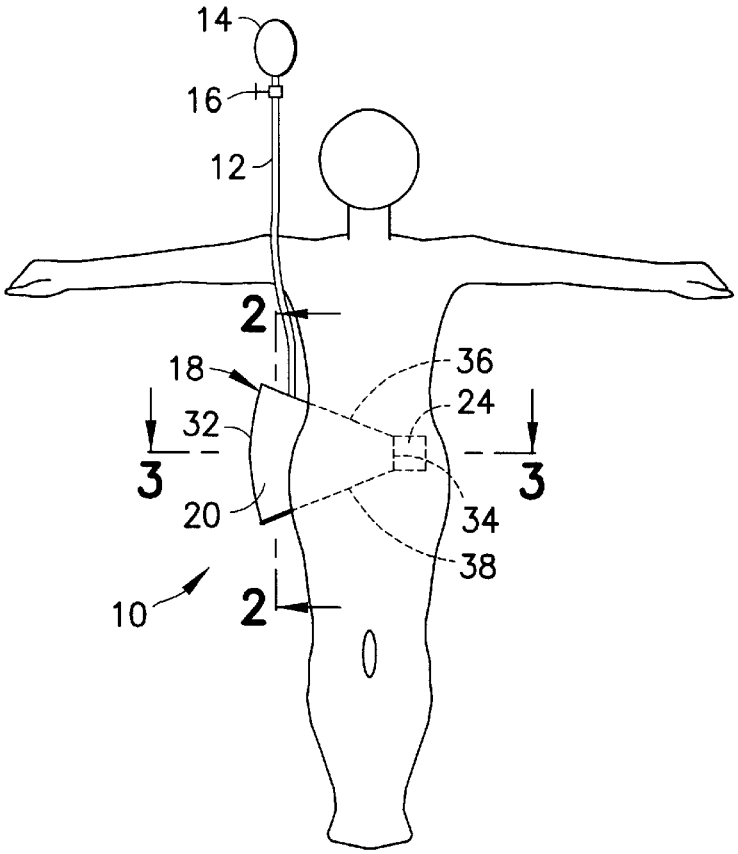
FIG. 1 is a top plan view of a patient supported by the wedge-shaped inflatable positioning aid in accordance with the first embodiment of the subject invention.
Figure 2:
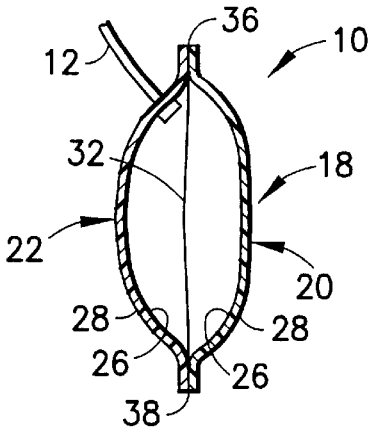
FIG. 2 is a cross-sectional view taken along line 2—2 in FIG. 1.
Figure 3:
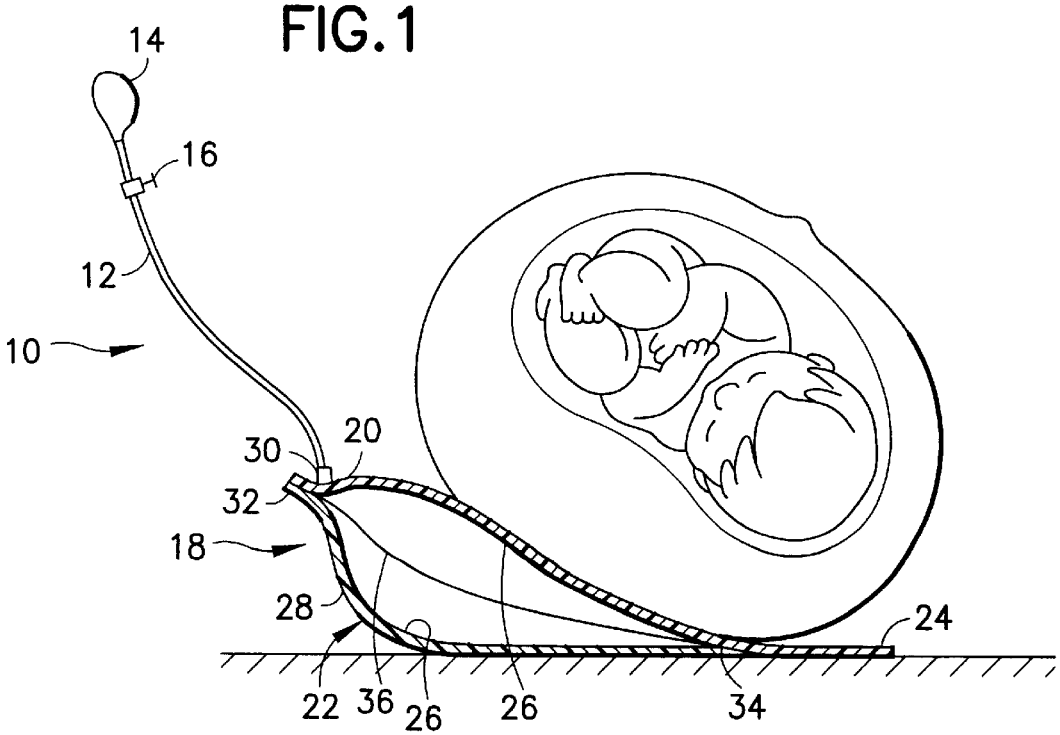
FIG. 3 is a cross-sectional view taken along line 3—3 in FIG. 1.

An inflatable positioning apparatus in accordance with a first embodiment of the subject invention is identified generally by the numeral 10 in FIGS. 1–3. The inflatable positioning apparatus 10 includes a tube 12, a pump 14 and a valve 16. In addition to the valve 16, the pump 14 is provided with two one-way valves (not shown). The first one-way valve is operative to permit air to flow from the pump 14 to the tube 12 each time the pump 14 is manually squeezed. However, this first one-way valve prevents a return flow of air from the tube 12 into the pump 14. The second one-way valve permits air flow from the ambient environment into the pump 14 as the pump 14 resiliently expands from the squeezed condition to the expanded condition. This second one-way valve, however, prevents an outflow of air from the pump to the ambient environment. The tube 12, the pump 14 and the valve 16 all may be of prior art design.

The positioning apparatus 10 further includes an inflatable pillow 18 connected to the end of the flexible tube 12 remote from the pump 14. The inflatable pillow 18 is formed from substantially trapezoidal top and bottom sheets 20 and 22 each of which has long and short parallel edges and a pair of non-parallel edges. The longer of the parallel edges of each of the top and bottom sheets 20 and 22 are substantially identically dimensioned, and the non-parallel edges converge at substantially identical angles from the longer parallel edge of each sheet 20 and 22. However, the top sheet 20 preferably is longer than the bottom sheet 22, such that the distance between the parallel edges on the top sheet 20 is greater than the distance between the parallel edges on the other of bottom sheet 22. With these relative shapes, the two sheets 20 and 22 can be such that the longer parallel edges of the sheets 20 and 22 will register with one another and the non-parallel edges of the bottom sheet 22 will register with portions of the non-parallel edges of the top sheet 20. However, the top sheet 20 will extend beyond the shorter parallel edge of the bottom sheet to define a non-inflatable flap 24.

The sheets 20 and 22 both are formed from a nylon material with a thickness in the range of 70–400 denier, and preferably about 200 denier. Each sheet 20 and 22 has an inner surface 26 laminated with a layer of urethane that has a thickness of approximately 3.5 mil. Each sheet 20 and 22 further may have a kiss coat of urethane on its outer surface 28 to a thickness that may be in the range of 0.25–0.50 inch.

One of the sheets 20 or 22 has a fitting 30 mounted thereto at a location in proximity to the longer parallel edge. The fitting 30 may include a flange and a cylindrical portion extending from the flange. The cylindrical portion is passed through an aperture formed in the sheet 20 or 22 such that the flange abuts the inner surface 26 of the sheet 20 or 22. The flange of the fitting 30 then is welded or adhered in position. The sheets 20 and 22 then have their respective inner surfaces 26 placed in opposing relationship to one another such that the longer parallel edges of the sheets 20 and 22 are registered. In this condition, the non-parallel edges of the bottom sheet 22 will register with portions of the non-parallel edges of the top sheet 20, and the shorter parallel edge of the bottom sheet 22 will extend transversely across the top sheet 20. The registered sheets 20 and 22 then are subjected to an RF welding apparatus which welds the bottom sheet 20 to the top sheet 22 around the periphery of the bottom sheet 20. In particular, the RF welding apparatus applies pressure and radio frequency energy which causes the urethane lamination on the inner surfaces 26 to bond the two sheets 20 and 22 together around the periphery of the bottom sheet 20. Thus, an inflatable region is defined between the sheets and within the area bounded by the periphery of the bottom sheet 20.

With this construction, as shown in FIGS. 1–3, the inflatable pillow 18 includes a long parallel welded seam 32, a short parallel welded seam 34, and a pair of non-parallel welded seams 36 and 38 that converge toward one another from the long parallel welded seam 32 toward the short parallel welded seam 34. Additionally, the inflatable pillow 18 includes the non-inflatable flap 24 that extends beyond the short parallel seam 34. The kiss coating of urethane on the outer surfaces 28 provides a fluid repellency to the inflatable pillow. In particular, the kiss coating of urethane seals the nylon material of the sheets 20 and 22 and at least partly smoothes out the peaks and valleys inherently present in the nylon. As a result, fluids, such as blood or sweat that may be generated during the medical procedure will be repelled.

Air may be inserted into the inflatable pillow 18 under the action of the pump 14 to cause the pillow 18 to assume a substantially wedge-shape. As shown in FIG. 3, the wedge-shaped pillow 18 has a small end at the seam 34 and a large end at the seam 32. The direction of more air into the pillow 18 will cause the volume of the large end of the pillow 18 to increase more than the volume of the small end, thereby enabling the pillow to support a patient at a correspondingly greater angle of tilt. The angle of tilt can be adjusted easily merely by releasing air from the inflatable pillow 18 or adding air thereto.

Forces exerted on the wedge-shaped pillow 18 by the weight of the patient will urge the pillow laterally, and thereby could cause the patient to move into a less tilted position. To prevent the lateral movement of the pillow 18, the non-inflatable flap 24 is positioned under the patient, and the weight of the patient on the non-inflatable flap 24 prevents the lateral movement of the wedge-shaped pillow 18. A similar tilting effect can be achieved by employing an inflatable pillow with rectangular top and bottom panels and a rectangular flap. The inflated wedge shape and the tilting of the patient can be achieved by positioning the seam between the inflatable pillow and the non-inflatable flap at a selected weight bearing location under the patient, such as under one buttocks.

Figure 4:
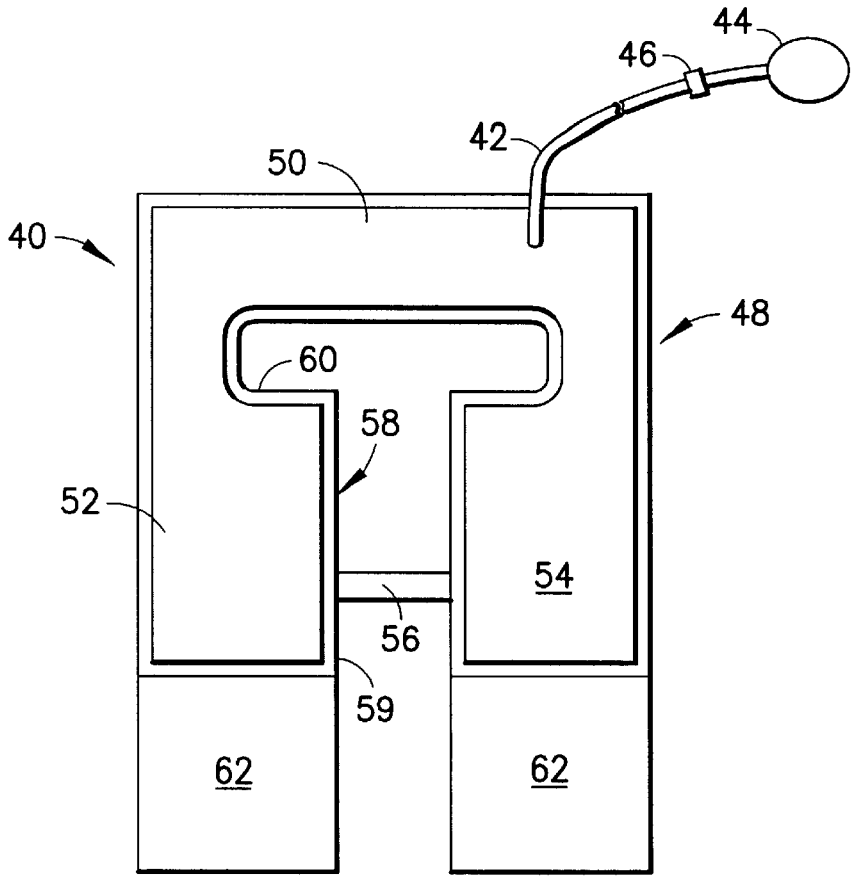
FIG. 4 is a top plan view of a second embodiment of the subject invention.
Figure 5:
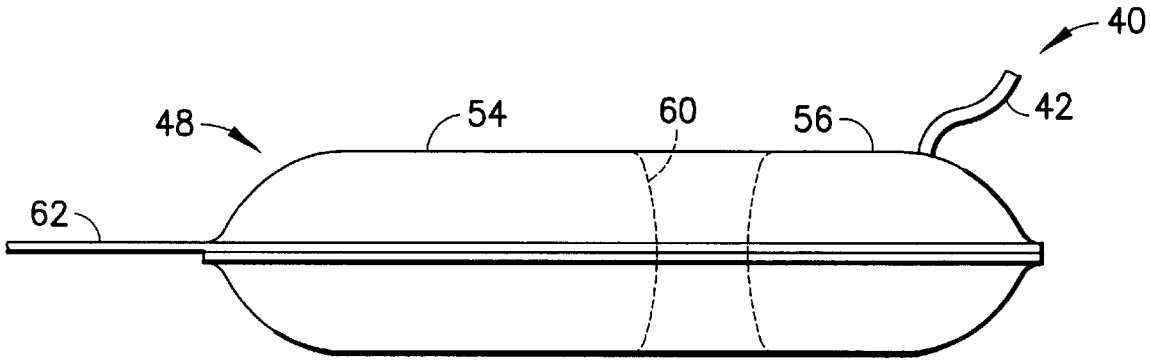
FIG. 5 is a side elevational view of the inflatable positioning aid shown in FIG. 4.

A second inflatable positioning apparatus is illustrated in FIGS. 4 and 5 and is identified generally by the numeral 40. The assembly 40 includes a flexible tube 42, a pump 44 and a valve 46 all of which are similar or identical to the tube, pump and valve described above and illustrated in FIGS. 1–3. The inflatable positioning assembly 40 further includes an inflatable pillow 48 having a substantially U-shape, or Ω-shape as shown most clearly in FIG. 4. The inflatable pillow 48 is formed from two sheets of urethane coated nylon, as described above with respect to the first embodiment. More particularly, the pillow 48 includes an inflatable connecting portion 50 and first and second inflatable legs 52 and 54 extending from the connecting portion 50. A non-inflatable connecting strap 56 extends between the inflatable legs 52 and 54 at locations furthest from the inflatable connecting portion 50.

The connecting portion 50 and the legs 52 and 54 are dimensioned and configured to define an opening 58 therebetween. The opening 58 includes a nose and mouth receiving portion 59 extending substantially parallel to the inflatable legs 52 and 54. Additionally, the opening 58 includes an eye-receiving portion 60 extending transverse to the inflatable legs 52 and 54 and substantially parallel to the inflatable connecting portion 50.

The inflatable pillow 48 can be used during surgical or chiropractic procedures that require the patient to assume a prone (face down) position. The unique shape of the inflatable pillow 48 ensures that the air passages will remain open and that the eyes will be substantially free of pressure. The condition of the air passages and the eyes can be checked by forming the inflatable pillow 48 from a substantially transparent nylon with a substantially transparent coating of urethane thereon. The transparency would enable the anesthesiologist to visually observe the face of the patient. In this embodiment, non-inflatable flaps 62 may extend from ends of the inflatable legs 52 and 54 remote from the inflatable connecting portion 50. The flaps 62 are dimensioned to be positioned under the chest of the patient and to prevent shifting of the inflatable pillow 38 during inflation and during the medical procedure.

Figure 6:
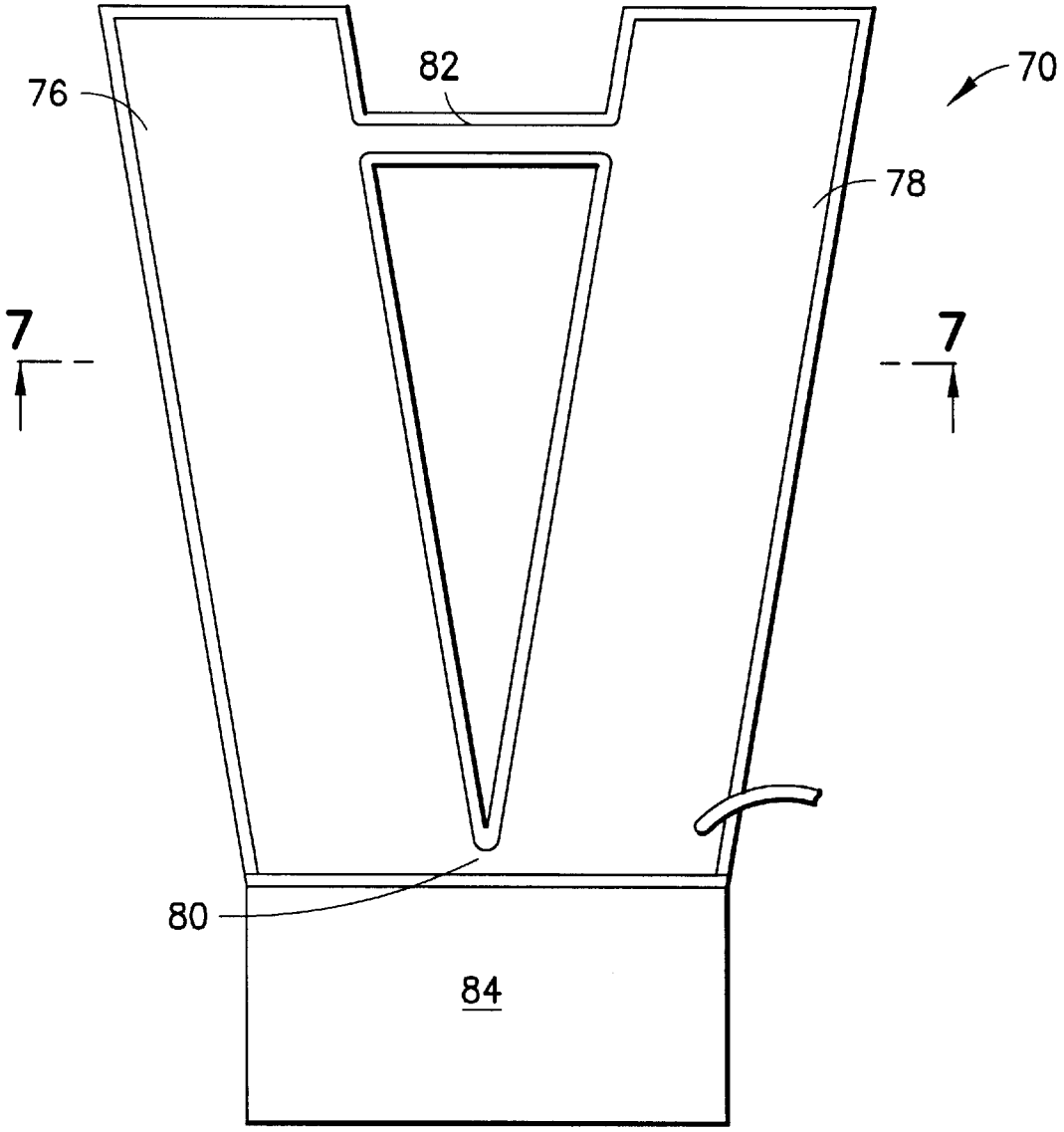
FIG. 6 is a top plan view of a third embodiment.
Figure 7:
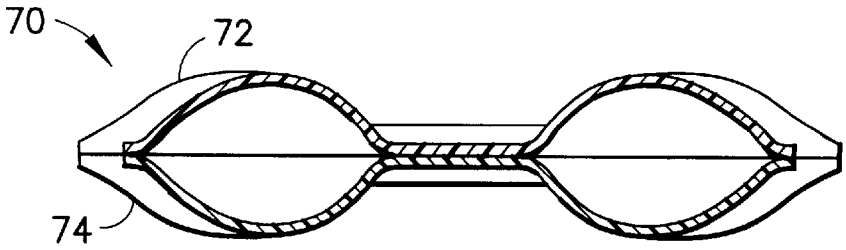
FIG. 7 is a cross-sectional view taken along line 7—7 in FIG. 6.

A third embodiment of a positioning apparatus is illustrated in FIGS. 6 and 7, and is identified generally by the numeral 70. The apparatus 70 includes urethane coated nylon top bottom panels 72 and 74 which are welded to one another about peripheral regions. The top panel 72 and portions of the bottom panel 74 registered therewith are of generally V-shape, such that the apparatus 70 has first and second inflatable arms 76 and 78 that diverge from an inflatable base portion 80. Portions of the arms 76 and 78 remote from the base portion 80 are connected to one another by an inflatable connecting tube 82 that limits the amount of divergence of the inflatable arms 76 and 78 during inflation and during the medical procedure and that helps to stabilize the apparatus 80. A non-inflatable flap 84 extends unitarily with the top or bottom panel 72, 74 away from the inflatable connecting portion 80. The non-inflatable flap 84 can be positioned under the hips of a patient lying face down in a prone position. The inflatable arms 76 and 78 of the positioning device 70 can be positioned under the torso such that the space between the inflatable arms 76 and 78 substantially aligns with the sternum of the patient. Inflation of the device will slightly elevate the torso of the patient from the hips, and will cushion the weight of the patient that would otherwise be placed directly on the chest. The inflatable positioning aid 70 is particularly useful for back surgery.

Figure 8:
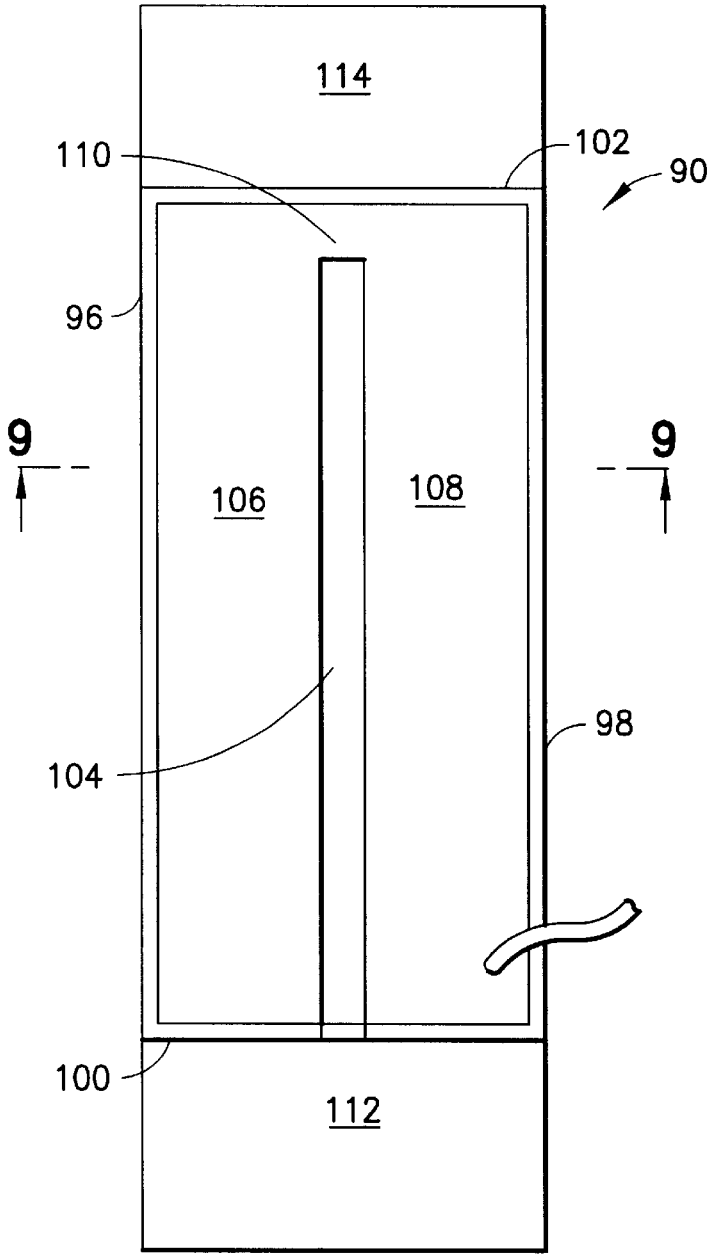
FIG. 8 is a top plan view of a fourth embodiment of an inflatable positioning aid that is particularly useful for heart surgery.
Figure 9:
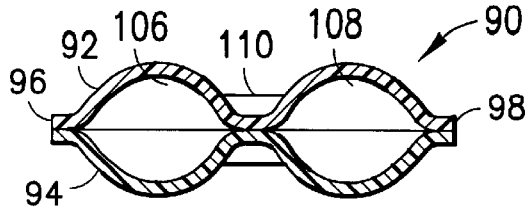
FIG. 9 is a cross-sectional view taken along line 9—9 in FIG. 8.

A fourth inflatable positioning aid is identified generally by the numeral 90 in FIGS. 8 and 9. The inflatable positioning aid 90 is intended primarily for heart surgery that requires the chest of the patient to be opened. The inflatable positioning aid 90 has rectangular top and bottom panels 92 and 94 formed from a urethane coated nylon, as in the first embodiment. Inflatable portions of the positioning aid 90 are secured to one another along opposed parallel longitudinal side edges 96 and 98 and along opposed parallel top and bottom ends 100 and 102. Additionally, the top and bottom panels 92 and 94 are secured to one another along a central connection portion 104 that extends from the bottom end 100 to a location near the top end 102. However, the central connection portion 104 is spaced from the top end 102 of the inflatable portion of the positioning aid 90. With this design, the inflatable positioning aid 90 defines first and second elongated inflatable portions 106 and 108 which are joined to one another at an inflatable connecting portion 110 near the top end 102.

The inflatable position aid 90 further includes a bottom flap 112 that extends from the bottom end 100 and a top flap 114 that extends from the top end 102. The bottom flap 112 may be disposed beneath the hips of the patient, while the flap 114 may be disposed beneath the head of the patient. Thus, this elongate inflatable positioning aid 90 is secured at both of its longitudinal ends to prevent shifting during inflation or during surgery. As shown most clearly in FIG. 9, central connecting portion 104 defines a groove extending longitudinally along a major portion of the length of the inflatable positioning aid 90. The groove is aligned with the spine to prevent the weight of the patient from exerting pressure on the spine during a lengthy surgery in which the chest of the patient is opened to access the heart. Additionally, the central connecting portion effectively defines two spaced apart inflatable chambers that stabily elevate both sides of the patient and that prevent tilting or rocking of the patient.

The fifth embodiment of the inflatable positioning aid is identified by the numeral 120 in FIGS. 10 and 11. The positioning aid 120 is formed from top and bottom panels, as in the previous embodiments. However, the panels are configured to define a toroidal head support 122 and a bar-shaped neck support 124 configured such that interior portions of the head support 122 and neck support 124 do not communicate with one another. However, the head support 122 and neck support 124 are connected along a connection line that extends substantially tangentially to the toroidal head support 122 and substantially parallel to the longitudinal axis of the bar-shaped neck support 124.

The inflatable positioning apparatus 120 further includes a single pump 126 communicating with a flexible tube 128. The end of the tube 128 remote from the pump 126 communicates with a valve 130 that is operative to selectively direct air to either a tube 132 or a tube 134. The tube 132 extends from the valve 130 to the toroidal head support 122. The tube 134 extends from the valve 130 to the bar-shaped neck support 124. By manually adjusting the valve 130, air from the pump 126 can be directed to either the toroidal head support 122 or the bar-shaped neck support 124. Similarly, by manually adjusting the valve 130, air can be released selectively and independently from the toroidal head support 122 or the bar-shaped neck support 124.

The inflatable positioning apparatus 120 can be employed by positioning the back of the head of a patient centrally within the toroidal head support 122 and by positioning the bar-shaped neck support 124 directly beneath the neck of the patient. The pump 126 and the valve 130 then can be used to selectively direct air to the toroidal head support 122 or the bar-shaped neck support 124 for inflating the respective supports appropriate amounts to cushion the head and to position the head and neck of the patient.

The preceding embodiments have schematically illustrated a manual inflation pump 14 in the form of a resiliently deflectable hollow bulb for directing air into the inflatable positioning aid. As an alternate to the manual inflation, the inflatable positioning aid may include an adaptor that enables connection of the inflatable positioning aid to a supply of compressed air that typically can be found in the operating room. The adaptor is identified generally by the numeral 140 in FIG. 12, and includes a short section of flexible tubing 142 with connections 144 and 146 at opposed ends thereof. The connection 144 is a Luer lock connector and includes a tapered nipple 148 and an internally threaded nut 150 surrounding the tapered nipple 148. The tapered nipple 148 is dimensioned to be received in the outlet 152 of the three-way valve 16. The internally threaded nut 150 is dimensioned to surround the outlet 152 and threadedly engage Luer lock projections on the outlet. The fitting 146 is a quick connect/disconnect fitting for connection to a supply of compressed gas 154, such as the types of fittings used for connecting a facial mask to a supply of nitrous oxide or oxygen. Such quick connect/disconnect fittings are sold, for example, by Colder Products Company of St. Paul, Minn. A chain 156 is mounted to the adaptor 140 at a location near the fitting 148. The chain 156 is provided with a conventional wire wrap that enables the adaptor 140 to be mounted in proximity to the supply of compressed gas.

The adaptor 140 is used by threadedly connecting the fitting 144 to the outlet 152 of the valve 16. The fitting 146 then is connected to the supply of compressed gas. The valve on the supply of compressed gas may be opened in the conventional manner to permit inflation of any of the inflatable positioning aids shown in FIGS. 1–11 herein. Typically the inflatable positioning aid will be over-inflated slightly. The valve 16 then is adjusted to close the outlet 152, and the adaptor 140 is separated either from the valve 16 or from the supply of compressed air. The doctor or other medical technician then may slightly open the valve 16 to permit a controlled escape of air from the inflatable positioning aid. The valve 16 then is closed when the proper degree of inflation is achieved. The adaptor 140 may be reconnected to further increase the amount of inflation at any time during the surgery.

While the invention has been described with respect to certain embodiments, it is apparent that various changes can be made without departing from the scope of the invention as defined by the claims.

What is claimed is:

1. An inflatable positioning assembly comprising an inflatable pillow consisting of a top panel and a bottom panel, said top and bottom panels having peripheral regions secured in face-to-face engagement with one another to define an inflatable portion therebetween, at least one of said top and bottom panels extending from the inflatable and defining at least one non-inflatable flap and means for selectively directing air into and out of said inflatable portion of said inflatable positioning assembly, the means for directing air into the inflatable portion comprising a tube extending from the inflatable portion, a valve connected to the tube, the valve having an outlet and a valving member for selectively opening and closing the outlet, a tubular adaptor having a first end with a threaded nut releasably connectable to the outlet of the valve for placing the tubular adaptor in communication with the outlet of the valve, the tubular adaptor further having a second end releasably connectable to a supply of compressed air.

2. The inflatable positioning assembly of claim 1, wherein the inflatable pillow is dimensioned relative to the non-inflatable flap to elevate one side of a patient relative to an opposed side of the patient at an angle of 20°–40°.

3. The inflatable positioning assembly of claim 1, wherein the inflatable pillow is substantially U-shaped, and includes an inflatable connecting portion and a pair of inflatable legs extending from and communicating with the inflatable connecting portion, a non-inflatable connecting strap extending between the inflatable legs for maintaining the inflatable legs in a selected spaced relationship relative to one another, the inflatable legs being configured to define a space therebetween for receiving at least the nose and mouth of a prone patient, the non-inflatable flap extending from at least one said inflatable leg.

4. The inflatable positioning assembly of claim 3, wherein inflatable legs are configured such that the space therebetween is substantially T-shaped, the T-shaped space including a pair of arms dimensioned and configured for registering with eyes of a patient when the nose and mouth of the patient are positioned in remaining portions of the T-shaped space.

5. The inflatable positioning assembly of claim 1, wherein the inflatable pillow comprises a toroidal portion and a bar-shaped portion aligned substantially tangentially to the toroidal portion.

6. The inflatable positioning assembly of claim 1, wherein said inflatable portion is substantially V-shaped with an inflatable connecting portion and a pair of inflatable arms diverging from said inflatable connecting portion, a non-inflatable strap extending between and connecting said inflatable arms at locations spaced from said inflatable connecting portion, and said non-inflatable flap extending from the inflatable connecting portion.

7. The inflatable positioning assembly of claim 1, wherein the inflatable portion is substantially U-shaped and comprises an inflatable connecting portion and a pair of substantially rectangular inflatable arms extending parallel to one another from said inflatable connecting portion, a non-inflatable connecting portion extending substantially continuously from the inflatable connection portion and between the inflatable arms.

8. The inflatable positioning assembly of claim 7, wherein the at least one non-inflatable flap comprises a first flap extending from portions of the inflatable positioning assembly adjacent the inflatable connecting portion and a second flap extending from portions of the inflatable arms remote from the inflatable connecting portion.

9. A method for positioning a patient during surgery, the patient having opposite first and second lateral sides, the method comprising:

providing an inflatable positioning aid consisting of a top panel and a bottom panel, said top and bottom panels having peripheral regions secured in face-to-face engagement with one another to define an inflatable portion and a non-inflatable flap extending from the inflatable portion therebetween;

placing the positioning aid under portions of the patient to be positioned, such that the non-inflatable flap is under a portion of the first lateral side only and such that at least part of the inflatable portion of the positioning aid is under a portion of the patient adjacent the second lateral side but not under the first lateral side; and directing compressed air into the inflatable portion of the inflatable positioning aid to elevate portions of the patient adjacent the second lateral side while portions of the patient supported on the non-inflatable flap are not elevated and limit movement of the inflatable positioning aid.

10. The method of claim 9, wherein the step of directing compressed air into the inflatable positioning aid comprises over-inflating the inflatable positioning aid, terminating the flow of compressed air into the inflatable positioning aid, and selectively releasing compressed air from the inflatable positioning aid until a desired inflation level is achieved.

11. The method of claim 9, wherein the step of directing compressed air into the inflatable portion comprises directing a sufficient volume of compressed air into the inflatable portion for elevating the second lateral sides of the patient to an angle of 20°–40° relative to the first lateral side of the patient.

12. The method of claim 9, wherein the inflatable positioning aid comprises a seam between the inflatable portion and the non-inflatable flap, and wherein the step of placing the positioning aid under portions of the patient to be positioned comprises aligning the seam substantially parallel to a lateral side of the patient.

13. The method of claim 12, wherein the step of placing the positioning aid under portions of the patient comprises placing the positioning aid under portions of the patient substantially aligned with the patient's hips.

14. The method of claim 9, further comprising connecting the inflatable positioning aid to a supply of compressed air.

15. The method of claim 14, wherein the inflatable positioning aid comprises a fitting permanently connected to the inflatable portion, a tube extending from the fitting and a valve connected to the tube, the valve having an outlet and a valving member for selectively opening and closing the outlet, the method further comprising the step of providing a tubular adaptor having a first end with a threaded nut configured for releasable connection to the outlet of the valve and a second end configured for releasable connection to a supply of compressed air, the method comprising threadedly connecting the first end of the tubular adaptor to the outlet of the valve and releasably connecting the second end of the tubular adaptor to the supply of compressed air prior to the step of directing compressed air into the inflatable portion.

16. An inflatable positioning assembly comprising an inflatable pillow having a top panel and a bottom panel, the top and bottom panels each comprise a sheet of nylon fabric having a thickness in the range of 70–400 denier, each of the top and bottom panels having an inwardly facing surface and an outwardly facing surface, the inwardly facing surface of each of said top and bottom panels having a coating of liquid and air impervious urethane with a thickness of approximately 3.5 mils, the outwardly facing surface of each of said top and bottom panels having a kiss coating of urethane thereon for resisting moisture, said top and bottom panels having peripheral regions with the inwardly facing surfaces adjacent the peripheral regions being secured in face-to-face engagement with one another to define an inflatable portion therebetween, at least one of said top and bottom panels extending from the inflatable portion and defining at least one non-inflatable flap, and means for selectively directing air into and out of said inflatable portion of said inflatable positioning assembly.

* * * * *